US008566981B2

(12) United States Patent
Connor, Jr.

(10) Patent No.: US 8,566,981 B2
(45) Date of Patent: Oct. 29, 2013

(54) BED IN A BOX AND METHOD

(75) Inventor: Steve Edwin Connor, Jr., Dongguan (CN)

(73) Assignee: Standard Furniture Manufacturing Company, Bay Minette, AL (US)

( * ) Notice: Subject to any disclaimer, the term of this patent is extended or adjusted under 35 U.S.C. 154(b) by 80 days.

(21) Appl. No.: 12/427,816

(22) Filed: Apr. 22, 2009

(65) Prior Publication Data

US 2010/0269257 A1 Oct. 28, 2010

(30) Foreign Application Priority Data

Apr. 22, 2009 (CN) ..... 2009 1 0131076

(51) Int. Cl.
*A47C 19/00* (2006.01)
*A47C 23/00* (2006.01)

(52) U.S. Cl.
USPC ..... 5/285; 5/177; 5/200.1; 5/201; 5/286; 5/240

(58) Field of Classification Search
USPC ..... 5/177, 285, 200.1, 201, 286, 202, 5/282.1, 240, 53.1, 132
See application file for complete search history.

(56) References Cited

U.S. PATENT DOCUMENTS

| | | | | |
|---|---|---|---|---|
| 19,544 | A * | 3/1858 | Clark | 5/288 |
| 206,765 | A * | 8/1878 | Bender | 5/177 |
| 5,257,428 | A * | 11/1993 | Carroll et al. | 5/620 |
| 5,438,723 | A * | 8/1995 | Carroll | 5/620 |
| 5,894,614 | A * | 4/1999 | Stroud | 5/200.1 |
| 2006/0037135 | A1 * | 2/2006 | Yang | 5/53.1 |
| 2007/0151026 | A1 * | 7/2007 | Felix | 5/201 |

* cited by examiner

*Primary Examiner* — Robert G Santos
*Assistant Examiner* — David E Sosnowski
(74) *Attorney, Agent, or Firm* — Sutherland Asbill & Brennan LLP

(57) ABSTRACT

A bed in a box is provided. The bed in a box comprises a plurality of components and a box. The plurality of components includes a headboard, a footboard, at least two first segments, at least one first connector for joining the at least two first segments end to end to form a first side rail, at least two second segments, at least one second connector for joining the at least two second segments end to end to form a second side rail, and a mattress support system. The plurality of components are disposed in the box. One or more of the at least two first segments is in a position other than end to end with another of the at least two first segments. One or more of the at least two second segments is in a position other than end to end with another of the at least two second segments. A bed frame and method for packing a bed in a box are also provided.

18 Claims, 5 Drawing Sheets

BED IN A BOX AND METHOD

CROSS-REFERENCE TO RELATED APPLICATION

This application claims benefit of Chinese Patent Application No. 200910131076.7, filed Apr. 22, 2009, which is incorporated herein by reference in its entirety.

TECHNICAL FIELD

This disclosure generally relates to bed frames, and more particularly relates to a bed frame packaged in a box.

BACKGROUND OF THE INVENTION

Large pieces of furniture, such as beds, can occupy a substantial amount of space. For instance, a king sized bed with a headboard could have a width of about 81 inches, a length of about 86 inches, and a height of about 56 inches. Even if the headboard, footboard, side rails, and mattress support system were disassembled from each other and packed, a box occupying about 30 cubic feet could be required. Thus, shipping and storage of the packaged furniture still requires a substantial amount of space, in particular when multiple pieces of furniture are packaged and shipped or stored en masse (e.g., as inventory). Accordingly, there is a need for an improved packaging of beds which avoids these disadvantages and deficiencies.

SUMMARY OF THE INVENTION

This disclosure provides a bed in a box comprising a plurality of components and a box. The plurality of components includes a headboard, a footboard, at least two first segments, at least one first connector for joining the at least two first segments end to end to form a first side rail, at least two second segments, at least one second connector for joining the at least two second segments end to end to form a second side rail, and a mattress support system. The plurality of components are disposed in the box. One or more of the at least two first segments is in a position other than end to end with another of the at least two first segments. One or more of the at least two second segments is in a position other than end to end with another of the at least two second segments.

This disclosure also provides a bed frame comprising a plurality of components including a headboard, a footboard, at least two first segments, at least one first connector for joining the at least two first segments end to end to form a first side rail, at least two second segments, at least one second connector for joining the at least two second segments end to end to form a second side rail, and a mattress support system.

This disclosure further provides a method for packing a bed in a box comprising forming a stack comprising a headboard, a footboard, at least two first segments, at least one first connector for joining the at least two first segments end to end to form a first side rail, at least two second segments, at least one second connector for joining the at least two second segments end to end to form a second side rail, and a mattress support system such that one or more of the at least two first segments is in a position other than end to end with another of the at least two first segments and one or more of the at least two second segments is in a position other than end to end with another of the at least two second segments.

Other objects, features, and advantages of this invention will be apparent from the following detailed description, drawings, and claims.

DETAILED DESCRIPTION OF EMBODIMENTS

Figure 1A:
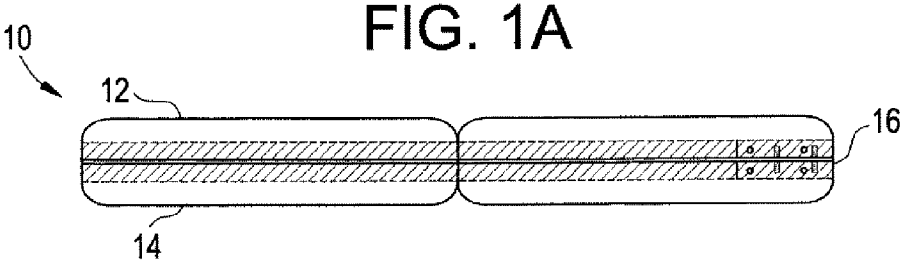
FIG. 1A-1B is a top view of a side rail 10 made in accordance with an embodiment of the present disclosure.

As summarized above, this disclosure encompasses a bed in a box, a bed frame, and a method for packing a bed in a box. The bed in a box comprises a headboard, a footboard, at least two first segments, at least one first connector for joining the at least two first segments end to end to form a first side rail, at least two second segments, at least one second connector for joining the at least two second segments end to end to form a second side rail, and a mattress support system. As discussed in further detail below, one or more of the first segments are in a position other than end to end with another of the at least two first segments and one or more of the at least two second segments is in a position other than end to end with another of the at least two second segments. As used herein, "bed" and "bed frame" are used interchangeably. The box may comprise any sized bed, including but not limited to, a twin bed, a full-size bed, a queen-size bed, or a king-size bed. As used herein, "box" refers to any type of container, such as a carton, a bag, or the like.

Embodiments of the headboard may comprise any headboard known in the art. In certain embodiments, the headboard may include a upper portion and a lower portion. For example, the upper portion may comprise a board having leg portions extending from the bottom corners of the board. The lower portion may comprise legs that are adapted to be joined to the leg portions end to end. In certain embodiments, the legs may be joined with the leg portions by a hinge, a bracket, a brace, a plate, a lap joint, a bolt, a screw, a combination thereof, or the like. In one embodiment, the headboard is upholstered. In some embodiments, the upper portion and the lower portion are in a position other than end to end with each other in the box.

Embodiments of the footboard may comprise any footboard known in the art. In one embodiment, the footboard is upholstered.

Embodiments of the at least two first segments (e.g., two, three, four, or more segments) may be joined end to end to form a first side rail using at least one first connector. In certain embodiments, the first connector comprises a hinge, a bracket, a brace, a plate, a lap joint, a bolt, a screw, a T nut, or other metal to metal insert, a combination thereof, or the like. In one embodiment, the first segments may be upholstered.

In some embodiments, each of the first segments has a length ranging from about 37 inches to about 43 inches. In other embodiments, each of the first segments has a length ranging from about 37 inches to about 41 inches. In still other embodiments, each of the first segments has a length ranging from about 40 inches to about 41 inches.

In some embodiments, the first side rail has a length ranging from about 75 inches to about 85 inches. In other embodiments, the first side rail has a length ranging from about 75 inches to about 82 inches. In still other embodiments, the first side rail has a length ranging from about 80 inches to about 82 inches.

In particular embodiments, the at least two second segments (e.g., two, three, four, or more segments) may be joined end to end to form a second side rail using at least one second connector. In certain embodiments, the second segment may be a "mirror image" of the first segments such that the first rail and the second side rail are identical except for the side of the bed frame on which each fits, on and correspondingly, "mirroring" the placement of its parts. Thus, embodiments of the second segments, second connectors, and second side rail may have similar characteristics as described above in reference to the first segments, first connectors, and first side rail.

Figure 1B:
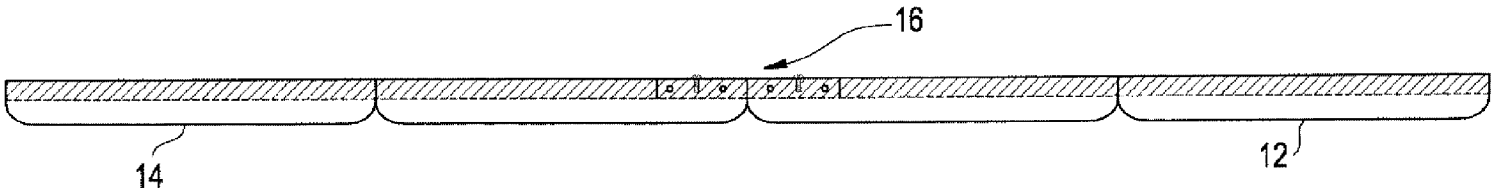
Figure 1C:
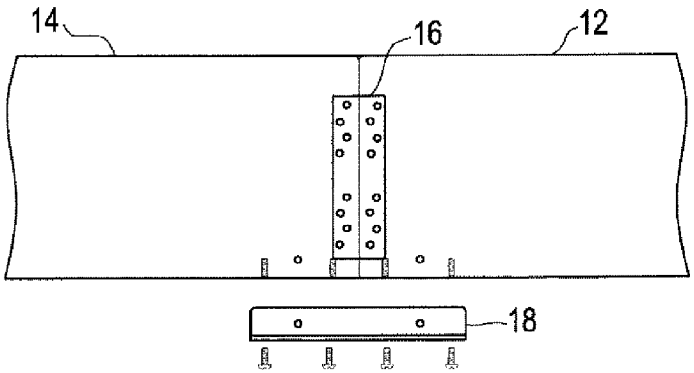
FIG. 1C is a side view of a portion of a side rail 10 made in accordance with an embodiment of the present invention.

FIGS. 1A-C illustrate an embodiment of a side rail 10 comprising two first segments 12, 14 which are joined by a hinge 16. In FIG. 1A, the first segments 12, 14 are in a position other than end to end with one another. In particular, the first segment 12 is folded on top of the first segment 14 at the hinge 16. Thus, when packed in the box, the two first segments 12, 14 have a length that is half of the length of the side rail 10. FIG. 1B illustrates the side rail 10 with the first segments positioned end to end, as the side rail 10 would be used in a bed frame. FIG. 1C illustrates a side view of a portion of the inside (i.e., the side that would be adjacent to the mattress when used in a bed frame) of the side rail 10. As shown in this embodiment, the connector comprises, in addition to the hinge 16, a bracket 18 to be attached to the bottom (i.e., the surface of the two first segments that would face the floor when used in a bed frame) with screws. Thus, this embodiment of a side rail 10 is capable of be packaged in a box in a configuration which is half its length and then may be easily unfolded at the hinge 16 and then fixed by the bracket 18 in position for installation in a bed frame, Embodiments of the mattress support system may include a plurality of side rail lips, at least one center support (with or without props), a combination thereof, or the like.

According to particular embodiments of the bed in a box, the box occupies a space ranging from about 12 cubic feet to about 22 cubic feet. In other particular embodiments, the box occupies a space ranging from about 12 cubic feet to about 16 cubic feet. In still other particular embodiments, the box occupies a space ranging from about 12 cubic feet to about 15 cubic feet.

According to particular embodiments of the bed in a box, the box has a length ranging from about 58 inches to about 87 inches, a width ranging from about 40 inches to about 44 inches, and a height of about 8 inches to about 10 inches. In other particular embodiments, the box has a length ranging from about 58 inches to about 73 inches, a width ranging from about 40 inches to about 42 inches, and a height of about 8 inches to about 9 inches. In still other particular embodiments, the box has a length ranging from about 65 inches to about 73 inches, a width ranging from about 41 inches to about 42 inches, and a height of about 8.5 inches to about 9.5 inches.

Figure 2:
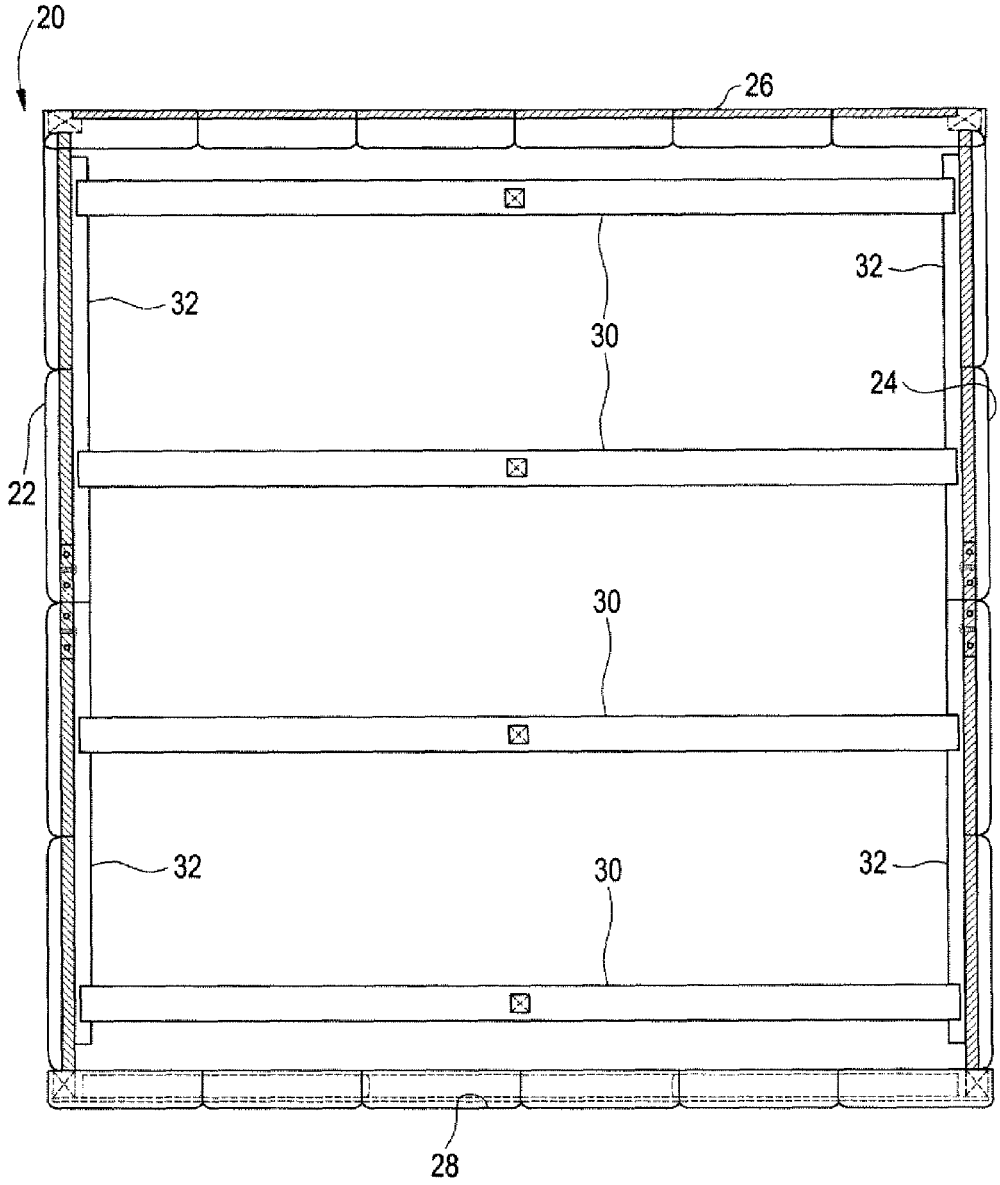
FIG. 2 is a top view of a bed frame 20 made in accordance with an embodiment of the present invention.
Figure 3:
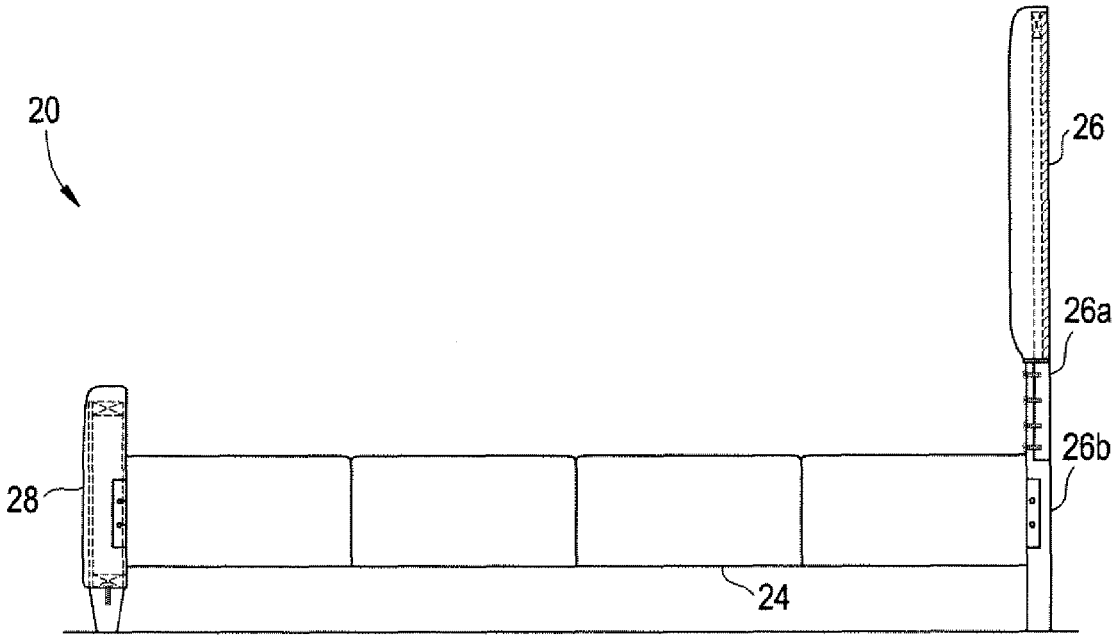
FIG. 3 is a side view of a bed frame 20 made in accordance with an embodiment of the present invention.

FIG. 2 shows a top view of a bed frame 20 made in accordance with an embodiment of the present invention. The assembled bed frame 20 includes a first side rail 22, a second side rail 24, a headboard 26, a footboard 28, and a mattress support system comprising four center supports 30 (each with center props), and four side rail lips 32 attached to (e.g., screwed into) the inside of the first and second side rails. In FIG. 3, it can be seen that the headboard 26 includes a upper portion 26*a* and a lower portion 26*b*, which are joined together end to end by a lap joint and screws. The first and second side rails 22, 24 are joined to the bottom portion of the headboard 26 with hook plates and pins as known in the art. In alternate embodiments, the first and second side rails 22, 24 are joined to the bottom portion 26*b* of the headboard 26 and footboard 28 with any other methods known in the art.

Embodiments of a method for packing a bed in a box arc also provided by the present disclosure. In certain embodiments, the method comprises forming a stack comprising a headboard, a footboard, at least two first segments, at least one first connector for joining the at least two first segments end to end to form a first side rail, at least two second segments, at least one second connector for joining the at least two second segments end to end to form a second side rail, and a mattress support system such that one or more of the at least two first segments is in a position other than end to end with another of the at least two first segments and one or more of the at least two second segments is in a position other than end to end with another of the at least two second segments.

Figure 4:
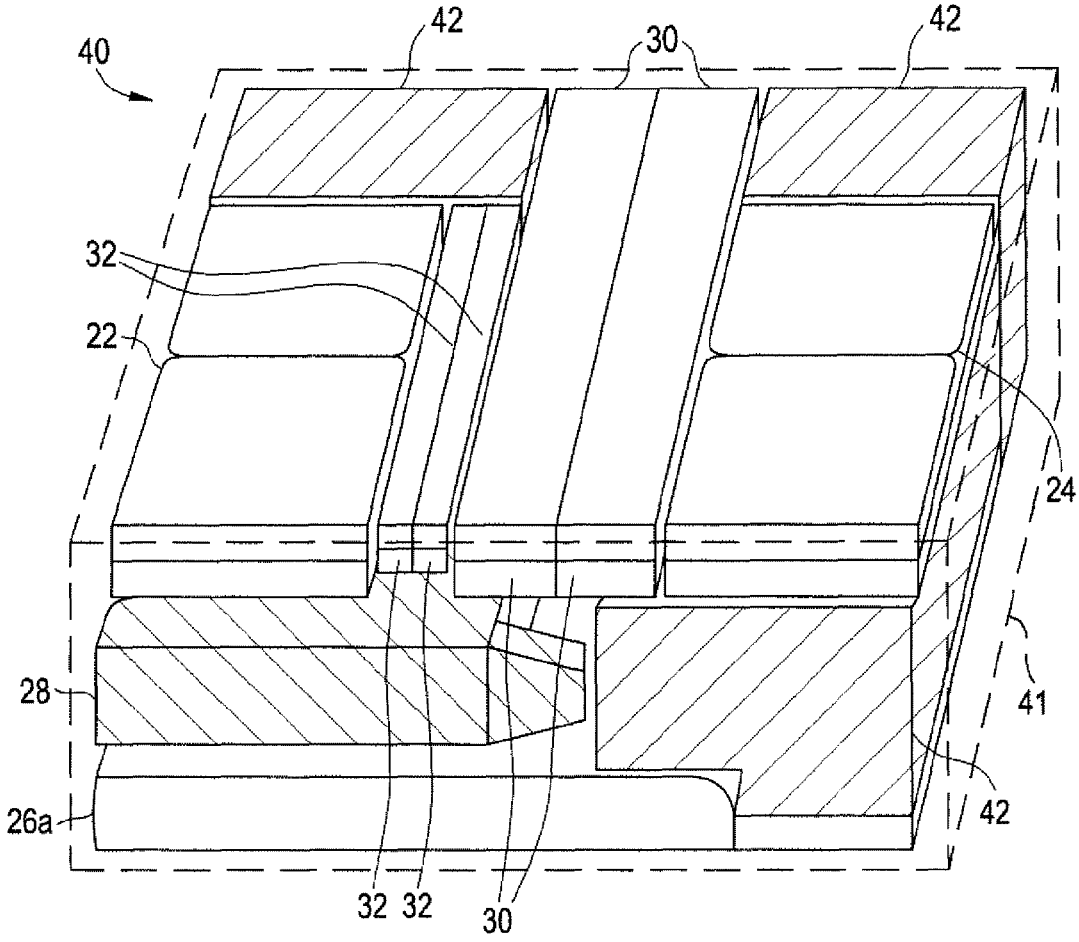
FIG. 4 is a perspective view of a stack 40 in a box 41 comprising a plurality of components of a bed frame made in accordance with an embodiment of the present invention.

FIG. 4 illustrates an embodiment of a stack 40 in a box 41 including a plurality of components. Like elements in FIGS. 2, 3, and 4 are numbered with like numerals. In the illustrated embodiment, the stack 40 includes the upper portion 26*a* of the headboard at the bottom, the footboard 28 on top of the upper portion 26*a* of the headboard, and the first side rail 22 (folded at a hinge) and the four side rail lip portions 32 on top of the footboard. The elements 42 comprise any additional components such as, for example, the bottom portion 26*b* of the headboard, first connectors, second connectors, or any other components of the bed. The elements 42 as illustrated appear as "boxes." However, it should be understood that the elements merely represent the other components in the stack, which may be "loose" or may be packaged in a box, bag, or the like. The stack further comprises the second side rail 24 (folded at a hinge) and the four center supports 30. Therefore, the bed may be packaged in a box 41 having the characteristic as described above in reference to the bed in a box.

Figure 5:
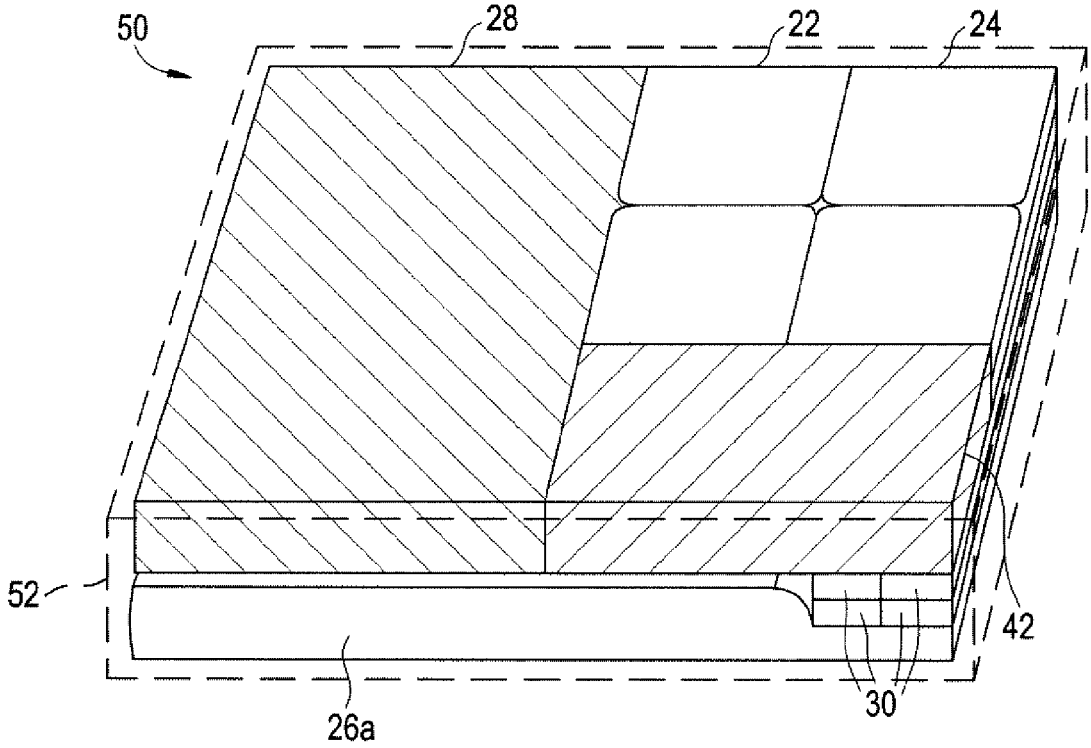
FIG. 5 is a perspective view of a stack 50 in a box 52 comprising a plurality of components of a bed frame made in accordance with another embodiment of the present invention.

FIG. 5 illustrates another embodiment of a stack 50 in a box 52 including a plurality of components. Like elements in FIGS. 2, 3, 4, and 5 are numbered with like numerals. The stack 50 includes the upper portion 26*a* of the headboard at the bottom, the four center supports 30, the footboard 28 (with the feet unattached), an element 42, and the first side rail 22 (folded at a hinge) on top of the upper portion 26*a* of the headboard. The element 42 may comprise additional components such as, for example, the four side lip portions 32, the feet of the footboard, the bottom portion 26*b* of the headboard, first connectors, second connectors, or any other components of the bed. The second side rail 24 (folded at a hinge) is adjacent to the first side rail 22 and above the four center supports 30. Thus, the bed may be packaged in a box 52 having the characteristic as described above in reference to the bed in a box.

Thus, it should be understood by a person of ordinary skill in the art, that in alternate embodiments (not shown), the first and second segments, and all the other components may be arranged differently in a stack to package the bed in a box. For instance, the first segments might not be joined and the second segments might not be joined, but yet one or more of the at least two first segments is in a position other than end to end with another of the at least two first segments and one or more of the at least two second segments is in a position other than end to end with another of the at least two second segments. In other embodiments, the components may be joined together in the stack. For example, the first segments, the second segments, the headboard, and or the footboard may be joined with, or include, the mattress support system.

In sum, the bed in the box described herein occupies less space during storage and transport, and yet can be easily assembled into a bed frame.

It should be apparent that the foregoing relates only to the preferred embodiments of the present application and that numerous changes and modifications may be made herein by one of ordinary skill in the art without departing from the generally spirit and scope of the invention as defined by the following claims and the equivalents thereof.

I claim:

1. A bed assembly in a box comprising:

a plurality of components including a headboard, a footboard, at least two first segments, at least one first connector for joining the at least two first segments end to end to form a first side rail having a length ranging from about 75 inches to about 85 inches, at least two second segments, at least one second connector for joining the at least two second segments end to end to form a second side rail having a length ranging from about 75 inches to about 85 inches, and a mattress support system, wherein the at least two first segments of the first side rail each include an inside surface that faces the mattress support system when the bed is assembled, wherein the at least two second segments of the second side rail each include an inside surface that faces the mattress support system when the bed is assembled, wherein the headboard comprises an upper portion and a lower portion; and a box having a longest side dimension ranging from about 58 inches to about 87 inches, wherein the plurality of components are disposed in the box in a stacked configuration, such that the inside surfaces of the at least two first segments of the first side rail face each other, the inside surfaces of the at least two second segments of the second side rail face each other, the first and second side rails are co-planar in a first plane and the upper portion of the headboard lies in a second plane substantially parallel to the first plane, the upper portion of the headboard and the lower portion of the headboard are in a position other than end to end with each other, and the headboard, the footboard, and the first and second side rails are unjoined to each other in the box.

2. The bed in a box of claim 1, wherein the at least one first connector comprises a hinge, a bracket, a brace, a plate, a lap joint, a bolt, a screw, or a combination thereof, and wherein the at least one second connector comprises a hinge, a bracket, a brace, a plate, a lap joint, a bolt, a screw, or a combination thereof.

3. The bed in a box of claim 1, wherein the mattress support system comprises a plurality of side rail lips, at least one center support, or a combination thereof.

4. The assembly of claim 1, wherein the plurality of components are disposed in the box such that the footboard is stacked in a plane other than the second plane.

5. The assembly of claim 4, wherein the footboard is stacked in the first plane.

6. The assembly of claim 1, wherein the upper portion of the headboard comprises board and leg portions, and the lower portion of the headboard comprises legs adapted to be joined end to end with the leg portions of the upper portion of the headboard.

7. The assembly of claim 1, wherein the headboard, the footboard, the first side rail, and the second side rail are upholstered.

8. The assembly of claim 1, wherein the box has a volume from about 12 cubic feet to about 16 cubic feet.

9. The assembly of claim 1, wherein the box has a volume from about 12 cubic feet to about 22 cubic feet.

10. A bed frame comprising:

a plurality of components including a headboard, a footboard, at least two first segments, at least one first connector for joining the at least two first segments end to end to form a first side rail having a length ranging from about 75 inches to about 85 inches, at least two second segments, at least one second connector for joining the at least two second segments end to end to form a second side rail having a length ranging from about 75 inches to about 85 inches, and a mattress support system, wherein the at least two first segments of the first side rail each include an inside surface that faces the mattress support system when the bed is assembled, wherein the at least two second segments of the second side rail each include an inside surface that faces the mattress support system when the bed is assembled, wherein the headboard comprises an upper portion and a lower portion, wherein the plurality of components are configured such that they may be disposed in a box having a longest side dimension ranging from about 58 inches to about 87 inches, wherein the plurality of components are configured such that they may be disposed in the box in a stacked configuration such that the inside surfaces of the at least two first segments of the first side rail face each other, the inside surfaces of the at least two second segments of the second side rail face each other, the first and second side rails are co-planar in a first plane and the upper portion of the headboard lies in a second plane substantially parallel to the first plane, the upper portion of the headboard and the lower portion of the headboard are in a position other than end to end with each other, and the headboard, the footboard, and the first and second side rails are unjoined to each other in the box.

11. The bed frame of claim 10, wherein the at least one first connector comprises a hinge, a bracket, a brace, a plate, a lap joint, a bolt, a screw, or a combination thereof, and wherein the at least one second connector comprises a hinge, a bracket, a brace, a plate, a lap joint, a bolt, a screw, or a combination thereof.

12. The bed frame of claim 10, wherein the mattress support system comprises a plurality of side rail lips, at least one center support, or a combination thereof.

13. The bed frame of claim 10, wherein the plurality of components are configured such that they may be disposed in the box such that the footboard is stacked in a plane other than the second plane.

14. The bed frame of claim 13, wherein the plurality of components are configured such that they may be disposed in the box such that the footboard is stacked in the first plane.

15. The bed frame of claim 10, wherein the upper portion of the headboard comprises board and leg portions, and the lower portion of the headboard comprises legs adapted to be joined end to end with the leg portions of the upper portion of the headboard.

16. The bed frame of claim 10, wherein the headboard, the footboard, the first side rail, and the second side rail are upholstered.

17. The bed frame of claim 10, wherein the box has a volume from about 12 cubic feet to about 16 cubic feet.

18. The bed frame of claim 10, wherein the box has a volume from about 12 cubic feet to about 22 cubic feet.

* * * * *